United States Patent [19]

Diodati

[11] Patent Number: 5,072,933

[45] Date of Patent: Dec. 17, 1991

[54] EXERCISING APPARATUS

[75] Inventor: Joseph Diodati, Sault Ste. Marie, Canada

[73] Assignee: Diodatics Internationalinc Inc., Sault Ste. Marie, Canada

[21] Appl. No.: 497,952

[22] Filed: Mar. 22, 1990

[51] Int. Cl.[5] ..... A63B 21/06

[52] U.S. Cl. ..... 272/117; 272/122

[58] Field of Search ..... 272/117, 119, 122, 123, 272/124, 118, 93, 143, DIG. 4; D21/196, 197

[56] References Cited

U.S. PATENT DOCUMENTS

| | | | |
|---|---|---|---|
| D. 268,437 | 3/1983 | Giordano | D21/196 |
| 578,230 | 3/1897 | Gibson . | |
| 1,133,129 | 3/1915 | Govan | 273/171 |
| 1,316,683 | 9/1919 | Calvert | 272/122 |
| 1,422,888 | 7/1922 | Reeves et al. | 272/122 |
| 2,447,218 | 8/1948 | Trzesniewski | 272/123 |
| 4,079,932 | 3/1978 | Schuetz . | |
| 4,121,826 | 10/1978 | Liberatore . | |
| 4,673,179 | 6/1987 | Pengler | 272/122 X |
| 4,720,098 | 1/1988 | Gordon . | |
| 4,768,780 | 6/1988 | Hayes . | |
| 4,949,955 | 8/1990 | Keen | 272/117 |

FOREIGN PATENT DOCUMENTS

| | | |
|---|---|---|
| 1452530A | 1/1989 | U.S.S.R. . |
| 1459671A | 2/1989 | U.S.S.R. . |
| 65 | of 1906 | United Kingdom . |

*Primary Examiner*—Robert Bahr

[57] ABSTRACT

An exercising weight comprises a grip portion and a weight portion. The grip portion is rigidly mounted at an upper end of the weight portion and comprises an elongate cross member and elongate side members extending downwardly and inwardly from ends of the cross member to the upper end of the weight portion. The weight portion extends downwardly and outwardly from the upper end to a planar base. The weight portion may comprise an outer shell including a door which permits weighted units of different weights to be placed in the shell.

4 Claims, 2 Drawing Sheets

EXERCISING APPARATUS

FIELD OF THE INVENTION

This invention relates to exercising apparatus and particularly, but not exclusively, to an exercising weight for use in exercises normally executed using dumbbells.

BACKGROUND OF THE INVENTION

One of the most frequently used pieces of weight training apparatus is the dumbbell, which comprises a short cylindrical bar with weighted discs mounted at each end. Dumbbells are most often used in pairs but may also be used singly. A dumbbell typically comprises a cylindrical steel bar, which may be chrome-plated and provided with a knurled grip portion, and weighted discs which may be fixed to or integral with the ends of the bar, or may be removable to allow a user to vary the weight of the dumbbell. The majority of dumbbells provided with removable discs use steel to form the discs, though discs formed of concrete-filled plastic shell are also available.

Dumbbells may be used in a wide variety of exercises, in the majority of which the user grips the bar with one hand. However, a number of exercises require the user to use both hands and to, for example, hold the dumbbell by one of the discs. Such exercises are generally easily accomplished when using relatively light weights. However, when heavier weights are used, the physical size of the weighted discs necessary to provide the required weight, and also the location of the discs, may restrict the movement of the user and prevent the range of movement necessary for the proper execution of the exercise. Also, having the centre of gravity of the dumbbell located in line with the bar tends to make the control and balance of the heavily-weighted dumbbell more difficult.

The removable discs of "adjustable" dumbells are normally held on the bar using a locking collar. If a collar is improperly fitted, or loosens during use, there is a danger that the discs will fall from the bar. Also, when not in use, dumbbells are normally supported by points on the circumference of the weighted discs, such that when positioned on an inclined surface, a dumbbell is liable to roll to a position where it may become a hazard, this being particularly dangerous in an area where people are likely to be exercising with heavy weights.

SUMMARY OF THE INVENTION

According to one aspect of the present invention there is provided an exercising weight comprising a grip portion and a weight portion. The grip portion is rigidly mounted at an upper end of the weight portion and comprises an elongate cross member and side members extending downwardly from ends of the cross member. The weight portion extends outwardly and downwardly from the upper end to a base, the base having a planar support surface.

Preferably, the side members of the grip portion are also elongate and extend inwardly and downwardly from the cross member.

The weight portion and the grip portion may be of unitary construction or, alternatively, the grip portion may be detachably mounted to the weight portion.

In a preferred embodiment, the weight portion comprises an outer shell adapted to receive a separable weighted unit. A plurality of weighted units of common shape and size and different weight may be provided, such that the total weight of the exercising weight can be varied by selecting different weighted units for location in the shell.

In accordance with the further aspect of the present invention there is provided an exercising weight comprising a grip portion and a weight portion. The grip portion is rigidly mounted at an upper end of the weight portion and comprises an elongate cross member and elongate side members extending downwardly and inwardly from ends of the cross member. The weight portion is in the form of a truncated rectangular pyramid with front and rear faces of equal length and side faces of equal length and the side faces being shorter than the front and rear faces.

Thus, when a user is holding the exercising weight by the grip portion, the configuration of the grip portion and weight portion serve to maintain the centre of gravity of the exercising weight below the palm of the hand of the user. Also, as the weight portion is located below.the grip portion and is relatively narrow adjacent to the grip portion there is minimum interference between the weight portion and the body of the user.

By providing the weight portion in the form of a truncated pyramid, the weight portion has a planar base which permits the exercising weight, when not in use, to be placed on a surface from which the weight will not topple or roll.

BRIEF DESCRIPTION OF THE DRAWING

These and other aspects of the present invention will now be described, by way of example, with reference to the accompanying drawings, in which.

DETAILED DESCRIPTION OF THE DRAWING

Figure 1:
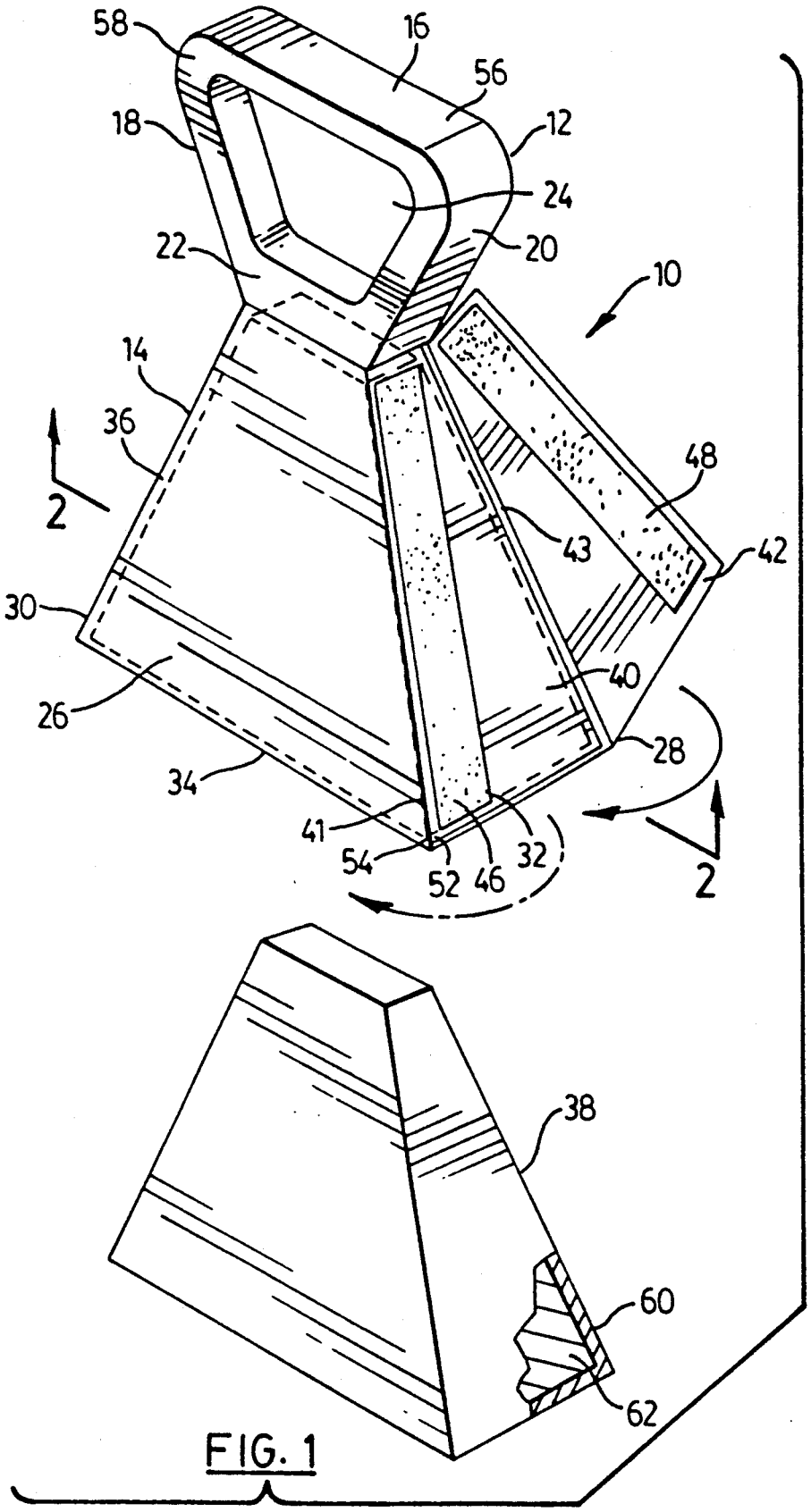
FIG. 1 is a perspective view of an exercising weight provided with a separable weighted unit, in accordance with a preferred embodiment of the present invention, the weighted unit being shown removed from the body of the exercising weight.
Figure 2:
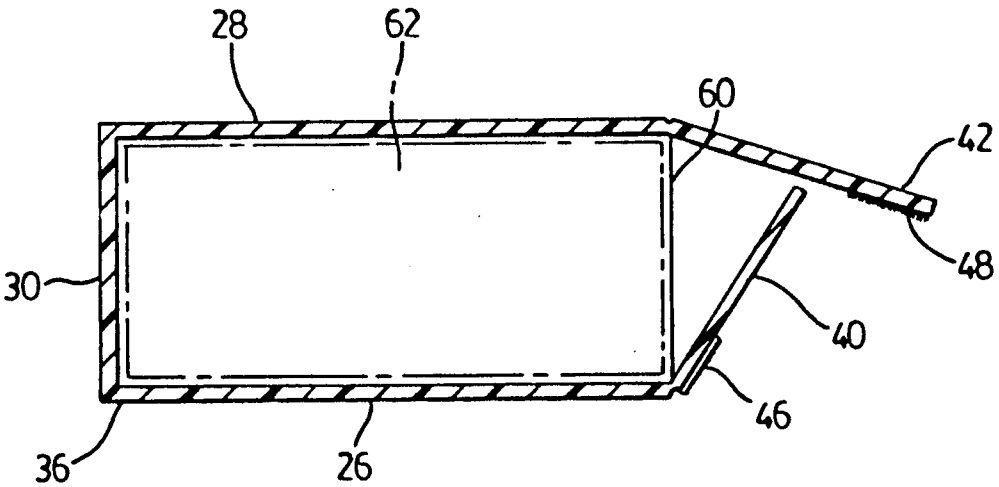
FIG. 2 is a sectional view on line 2—2 of FIG. 1.

The drawing illustrates an exercising weight, generally indicated at 10, sitting in an upright position on a flat surface. The weight 10 comprises a grip portion 12 which is rigidly mounted on a weight portion 14. The grip portion 12 includes an elongate cross member 16 and side members 18, 20 extending downwardly and inwardly from the ends of the cross member 16. The side members terminate at a lower cross member 22 which is fixed to the upper end of the weight portion 14. The members 16, 18, 20, 22 collectively define an inverted trapezoid with a central opening 24.

The weight portion 14 is in the form of a truncated rectangular pyramid having front and rear faces 26, 28 of equal size, and side faces 30, 32 of equal size, and a rectangular base 34.

In the illustrated example, the weight portion 14 comprises weight support means, in the form of an outer shell 36 and a separable weighted unit 38 which is received within the shell 36. The weighted unit 38 is of similar configuration to the interior of the shell 36, such that it may fit snuggly within the shell 36. Door means in the form of openable flaps 40, 42 are provided in one side face 32, the inner flap 40 being attached to the front face 26 and the outer flap 42 being attached to the rear face 28 by means of respective living hinges 41, 43. The inner flap 40 is slightly smaller than the side face and the outer surface of the flap is provided with a length of loop surface fastening tape 46, for engaging a corresponding length of hook surface fastening tape 48 provided on the inside surface of the outer flap 42.

In the illustrated example, the weight portion 14 is formed of an inner layer of plastic material 52 with a canvas covering 54. The grip portion 12 is formed of thicker plastic material 56 also provided with a canvas covering 58. The plastic 52, which forms the inner part of the weight portion 14, may be relatively thin, though the plastic 56, which forms a part of the grip portion 12, is somewhat thicker as the grip portion 12 should be substantially rigid. The exercising weight 10 may be formed by providing a sheet of canvas and affixing this to a sheet of plastic material, the composite sheet then being cut and folded to provide the exercising weight shape. Tape or other adhesive may be used to join the material at the meeting edges, and additional layers or inserts of plastic or other material may be provided for the formation of the grip portion 12.

In this particular example, the base of the weight 10 is 6" long and 3" wide, the front and rear faces 26, 28 narrowing to 2" at the upper end, and the side faces 30, 32 narrowing to 1". The weight portion 14 has a height of 5½". The grip portion 12 is 1" thick, has a height of 3½" and widens from the 2" long lower cross member 22 up to the cross member 16, which is 6" long. An exercising weight of these dimensions can comfortably accommodate weighted units of up to 35 lbs., greater weights requiring an increase in volume of the weight portion 14.

The weighted unit 38 comprises a plastic exterior shell 60 containing a relatively heavy material 62. The density and volume of the material 62 may be varied to provide a unit 38 of a chosen weight. Providing a sealed shell 60 allows the material to be loose or have little or no structural strength, such that relatively expensive cast or machined steel does not have to be used. While steel may be used, this construction allows various other materials to be used including: pig iron, magnetite, limontite, loose iron ore, lead, and galena. An advantage of using such products as magnetite and hematite is that they are considerably less expensive than steel.

Thus, to provide a range of different exercising weights it is only necessary to provide a grip and weight portion together with a plurality of different weighted units, the differences in weight of the units being achieved by, for example, providing weighted units filled with different materials.

In other embodiments of the invention, the weight portion 14 may be unitary and of a fixed weight. Also, a plurality of different weight portions may be provided together with a single grip portion which is releasably securable to the weight portions.

In further embodiments, a resilient outer coating may be provided over the exercising weight, or a resilient layer may be interposed between outer layers of the weight. This would serve to protect the user and would also, for example, minimize damage resulting from an exercising weight being dropped on a hard surface. Also, a variety of different surfaces may be provided such as a simple painted or coloured finish, a fabric, or even a fur or pile finish.

Also, the grip portion may be provided with external padding to make the cross member 16 or side members 18 and 19 more comfortable for gripping by a user. Also, a sleeve may be rotatably mounted on the cross member so that during, for example, lifting exercises where the hand of the user defines an arc, the cross member 16 does not rotate in direct contact with the palm of the hand of the user.

In use, the exercising weight 10 can be used in a variety of conventional dumbbell exercises, the weight 10 being held, with one hand, by the cross member 16, or with both hands, by the side members 18, 20. The side members 8, 19 may also be grasped by one hand for leverage exercises. The provision of the opening 24 also allows a user to place a foot through the grip portion such that the exercising weight 10 may be used for exercises such as leg lifts, where the user lies flat and, with a straight leg, lifts a weight attached to the foot.

For many of the traditional dumbbell exercises, the exercising weight 10 offers numerous advantages, including the location of the centre of gravity of the weight below, the hand of the user as the weight 10 will normally hand down from the grip portion and the hand of the user. Also, the absence of large diameter discs extending to either side of the hand, allows exercises such as curls to be followed through until the weight-supporting hand is touching the shoulder. In addition, in exercises such as curls, the configuration of the exercising weight leads to the centre of gravity remaining further from the body throughout the exercise and thus providing more resistance than would be normally available with a dumbbell of equal weight, especially during the upper stages of the exercise.

The configuration of the exercising weight also allows the weight to be easily mounted to, for example, waist straps to use in "squats" or to wrist straps to permit amputees or the physically disadvantaged to lift and exercise with the weights. The provision of an upwardly projecting grip portion also allows the exercising weight to be easily picked up or lifted from a floor surface, and facilitates the use of the weight by users who may be wheelchair-bound or who are otherwise best able to exercise in a seated position.

Thus, it may be seen that the exercising weight provides a convenient and easily used weight, avoiding many of the problems and disadvantages associated with a conventional dumbbell.

I claim:

1. An exercising weight comprising unitary grip and weight portions and a separable weighed unit, the grip portion being at an upper end of the weight portion and including an elongate cross member and side members extending downwardly from the ends of the cross member to the upper end of the weight portion, the weight portion extending outwardly and downwardly from the upper end to a base having a planar lower support surface, the weight portion including a weight supporting outer shell for receiving the separable weighted unit, the weight supporting outer shell further including a door means extending substantially along a side.

2. The exercising weight of claim 1 wherein the door means is in the form of openable flaps.

3. An exercising weight comprising a grip portion and a weight portion, the grip portion being rigidly mounted at an upper end of the weight portion and having an elongated cross member and a pair of elongate side members extending inwardly and downwardly from the ends of the cross member to the upper end of the weight portion to permit an operator to hold the weight by the cross member or by one or both of the side members, the weight portion extending outwardly and downwardly from the upper end to a base having a planar lower support surface;

the weight portion including a weight support means mounted to the grip portion and adapted for mounting a separable weighted unit therein and wherein the weight support means is in the form of an outer shell including door means extending substantially along a side to allow the separable weighted unit to be inserted into the interior of the shell.

4. An exercising weight as claimed in claim 2 wherein the door means is in the form of openable flaps.

* * * * *